US011662165B1

(12) United States Patent
Viani

(10) Patent No.: US 11,662,165 B1
(45) Date of Patent: May 30, 2023

(54) FIREARM MAGAZINE SLEEVE

(71) Applicant: Arthur J. Viani, Miami, FL (US)

(72) Inventor: Arthur J. Viani, Miami, FL (US)

( * ) Notice: Subject to any disclaimer, the term of this patent is extended or adjusted under 35 U.S.C. 154(b) by 0 days.

(21) Appl. No.: 17/536,675

(22) Filed: Nov. 29, 2021

(51) Int. Cl.
*F41A 9/65* (2006.01)

(52) U.S. Cl.
CPC ..... *F41A 9/65* (2013.01)

(58) Field of Classification Search
CPC ..... F41A 9/59; F41A 9/71; F41A 9/67; F41A 9/66; F41A 9/65; F41A 9/64; F41A 9/63; F41A 9/61; F41A 9/01
USPC ..... 42/50
See application file for complete search history.

(56) References Cited

U.S. PATENT DOCUMENTS 3,453,762 A * 7/1969 Fremont ..... F41A 9/67 42/50
5,174,482 A * 12/1992 Rogers ..... F42B 39/02 224/679
5,526,600 A * 6/1996 Chesnut ..... F41A 9/65 42/50
10,094,636 B1 * 10/2018 Asbury ..... F41A 9/65
10,690,427 B1 * 6/2020 August ..... F41A 9/67
2010/0281737 A1 * 11/2010 Cahill ..... F41A 9/70 42/50
2017/0138685 A1 * 5/2017 Beasley ..... F41A 9/71
2017/0146308 A1 * 5/2017 Plumb ..... F41A 9/65
2019/0154390 A1 * 5/2019 DiLeo ..... F41A 35/02
2020/0393209 A1 * 12/2020 Zhang ..... F41A 17/38
2021/0247156 A1 * 8/2021 Shreve ..... F41A 9/71

FOREIGN PATENT DOCUMENTS

WO WO-2020230135 A1 * 11/2020 ..... F16M 13/04

* cited by examiner

*Primary Examiner* — John Cooper
(74) *Attorney, Agent, or Firm* — Albert Bordas, P.A.

(57) ABSTRACT

A firearm magazine sleeve, having a sleeve assembly. The sleeve assembly has a sleeve forward wall, a sleeve aft wall having an aft top edge, first and second sleeve lateral walls, a bottom edge, a sleeve lip, and a sleeve internal face. The sleeve assembly further has top walls. The top walls have first and second top lateral walls, a top forward wall, a top aft wall, corners, an interior edge, and a top edge, whereby the top walls extend from the sleeve lip to the top edge. The top walls extend from the sleeve lip to form a perimeter, which encapsulate a magazine tube assembly and prevent the magazine tube assembly from flexing or deforming from impact forces. The sleeve assembly mounts onto the magazine tube assembly and secures onto the a magazine base assembly.

15 Claims, 5 Drawing Sheets

FIREARM MAGAZINE SLEEVE

BACKGROUND OF THE INVENTION

1. Field of the Invention.

The present invention relates to firearms, and more particularly, to firearm magazine sleeves.

2. Description of the Related Art.

Applicant is not aware of any prior art suggesting the novel features of the present invention.

SUMMARY OF THE INVENTION

The present invention is a firearm magazine sleeve, comprising a sleeve assembly. The sleeve assembly comprises a sleeve forward wall, a sleeve aft wall having an aft top edge, first and second sleeve lateral walls, a bottom edge, a sleeve lip, and a sleeve internal face. The sleeve assembly further comprising top walls. The top walls comprise first and second top lateral walls, a top forward wall, a top aft wall, corners, an interior edge, and a top edge, whereby the top walls extend from the sleeve lip to the top edge. The top walls extend from the sleeve lip to form a perimeter, which encapsulate a magazine tube assembly and prevent the magazine tube assembly from flexing or deforming from impact forces. The sleeve assembly mounts onto the magazine tube assembly and secures onto the a magazine base assembly.

The first and second sleeve lateral walls comprise first and second sleeve holes respectively. The sleeve assembly further comprises a semicircular tab. The first and second top lateral walls comprise first and second top lateral internal faces respectively. The first and second top lateral internal faces comprise first and second sleeve indents respectively. The first and second sleeve indents extend from the interior edge. The top walls extend from the sleeve lip to the top edge. The top walls define a first rectangular shape having a first predetermined perimeter, and sleeve assembly defines a second rectangular shape having a second predetermined perimeter. The first predetermined perimeter is smaller than the second predetermined perimeter. The semicircular tab extends from the aft top edge toward the top aft wall, and protrudes from the top edge.

The magazine tube assembly comprises a sidewall, a magazine top edge, a magazine lip, a magazine base edge, first and second magazine tabs, a magazine forward face, and a magazine aft face. The magazine base assembly comprises a base exterior face with indents, a base interior face, a perimeter edge, a forward face, a base edge, first and second lateral walls, grip sections, an aft face, a forward wall, and an aft wall. The first and second lateral walls comprise first and second tabs respectively. The first and second lateral walls, the forward wall, and the aft wall extend from the base interior face defining a lip. The first and second lateral walls each comprises apertures and lateral ridges, and the forward wall and the aft wall comprise ridges. The sleeve assembly mounts onto the magazine tube assembly, whereby the sleeve lip mounts onto the magazine lip and the first and second sleeve indents receive the first and second magazine tabs respectively. The sleeve assembly secures onto the magazine base assembly, whereby the first and second sleeve holes receive the first and second tabs respectively.

It is therefore one of the main objects of the present invention to provide a firearm magazine sleeve.

It is another object of this invention to provide a firearm magazine sleeve, which mounts onto a magazine tube assembly.

It is another object of this invention to provide a firearm magazine sleeve that comprises top walls.

It is another object of this invention to provide a firearm magazine sleeve having top walls, above a sleeve lip, to form a perimeter, which encapsulate a magazine tube assembly and prevents the magazine tube assembly from flexing or deforming from impact forces. Therefore, the entire assembled magazine assembly stays in place to prevent accidental disassembly.

It is another object of this invention to provide a firearm magazine sleeve, which receives a magazine base.

It is another object of this invention to provide a firearm magazine sleeve that can be disassembled with a sleeve disassembly tool.

It is another object of this invention to provide a firearm magazine sleeve, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
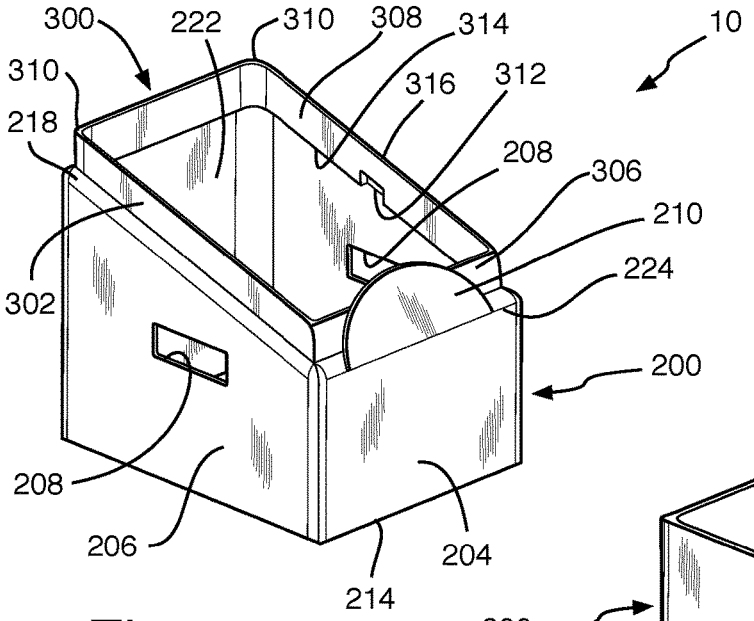
FIG. 1 is a top isometric view of a present invention sleeve assembly.

Referring now to the drawings, the present invention is a firearm magazine sleeve, and is generally referred to with numeral 10. It can be observed that it basically includes sleeve assembly 200 having top walls 300.

Figure 2:
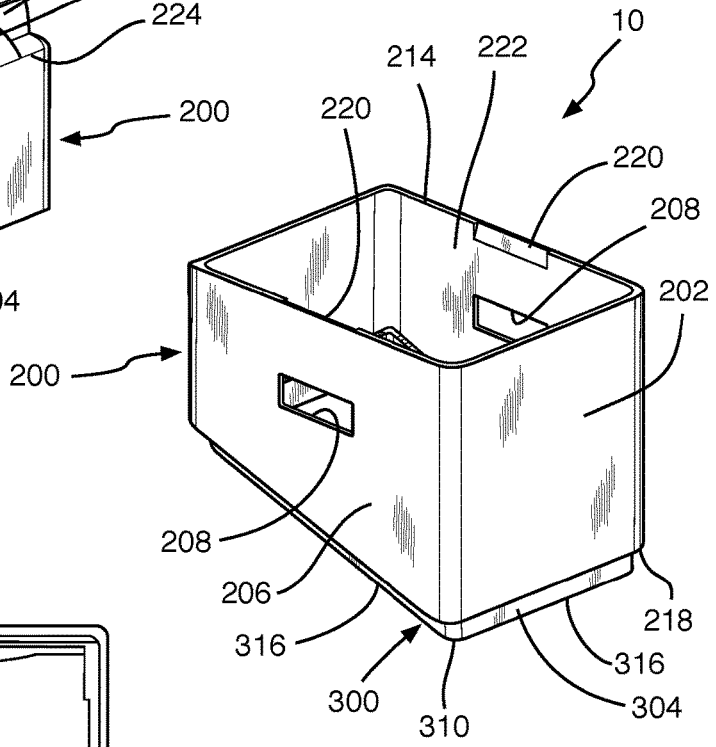
FIG. 2 is a bottom isometric view of the present invention sleeve assembly.
Figure 3:
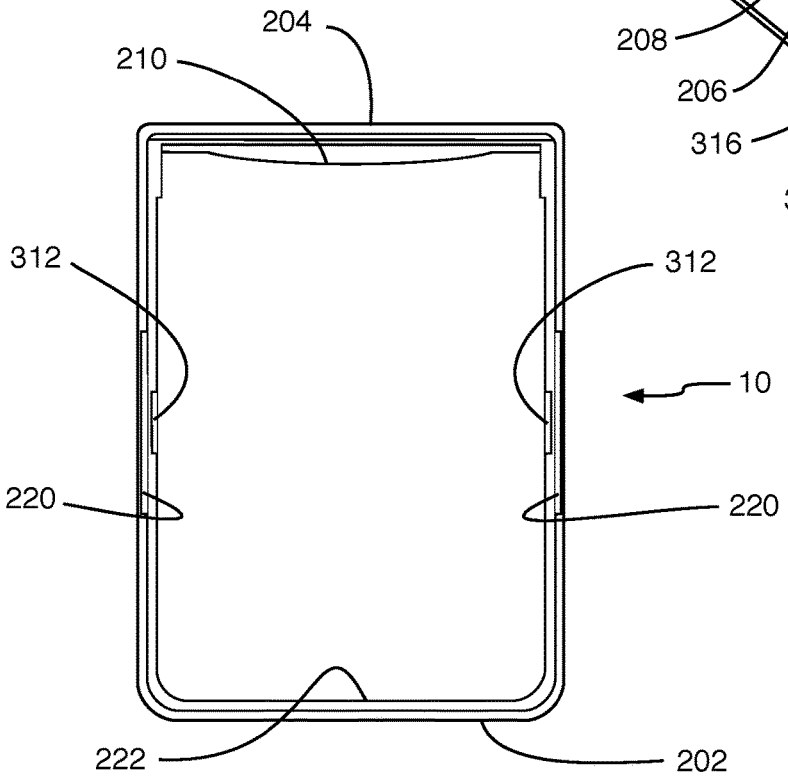
FIG. 3 is a bottom view of the present invention sleeve assembly.

As seen in FIGS. 1, 2, and 3, sleeve assembly 200 comprises sleeve forward wall 202, sleeve aft wall 204 having aft top edge 224, first and second sleeve lateral walls 206, bottom edge 214, sleeve lip 218, and sleeve internal face 222. First and second sleeve lateral walls 206 comprise first and second sleeve holes 208 respectively. Sleeve assembly 200 further comprises semicircular tab 210. Sleeve forward wall 202 defines a first predetermined distance from bottom edge 214 to sleeve lip 218, and sleeve aft wall 204 defines a second predetermined distance from bottom edge 214 to sleeve lip 218. The first predetermined distance is greater than the second predetermined distance. First and second sleeve lateral walls 206 are parallel to each other, and are perpendicular to sleeve forward wall 202 and sleeve aft wall 204. First and second sleeve lateral walls 206 comprise first and second bottom indents 220 respectively.

Top walls 300 comprise first and second top lateral walls 302, top forward wall 304, top aft wall 306, corners 310, interior edge 314, and top edge 316. First and second top lateral walls 302 comprise first and second top lateral internal faces 308 respectively. First and second top lateral internal faces 308 comprise first and second sleeve indents 312 respectively. First and second sleeve indents 312 extend from interior edge 314 towards top edge 316 without reaching top edge 316. Top walls 300 extend from sleeve lip 218 to top edge 316. Top walls 300 define a first rectangular shape having a first predetermined perimeter, and sleeve assembly 200 defines a second rectangular shape having a second predetermined perimeter, whereby the first predetermined perimeter is smaller than the second predetermined perimeter. Semicircular tab 210 extends from aft top edge 224 toward top aft wall 306, and protrudes from top edge 316.

Figure 4:
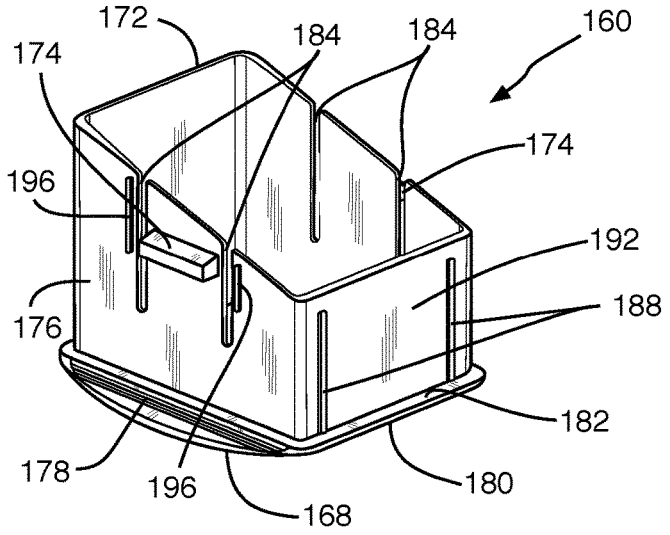
FIG. 4 is a top isometric view of a magazine base that secures the present invention sleeve assembly.
Figure 5:
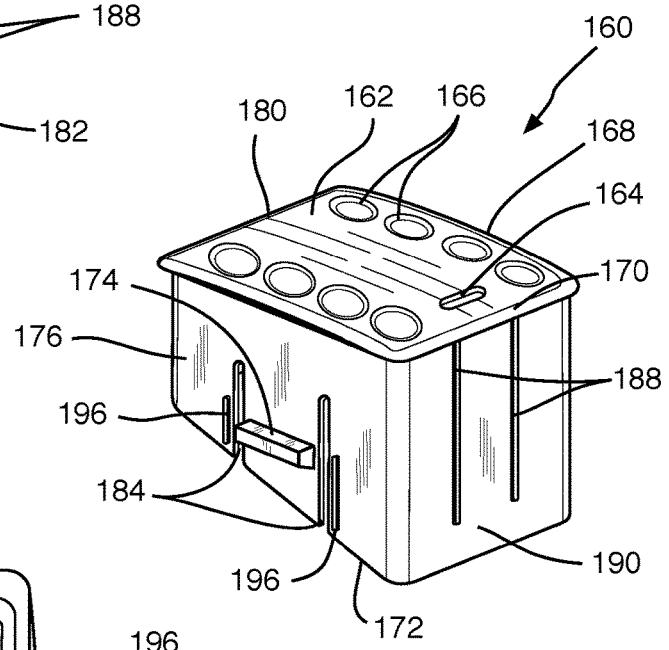
FIG. 5 is a bottom isometric view of the magazine base that secures the present invention sleeve assembly.
Figure 6:
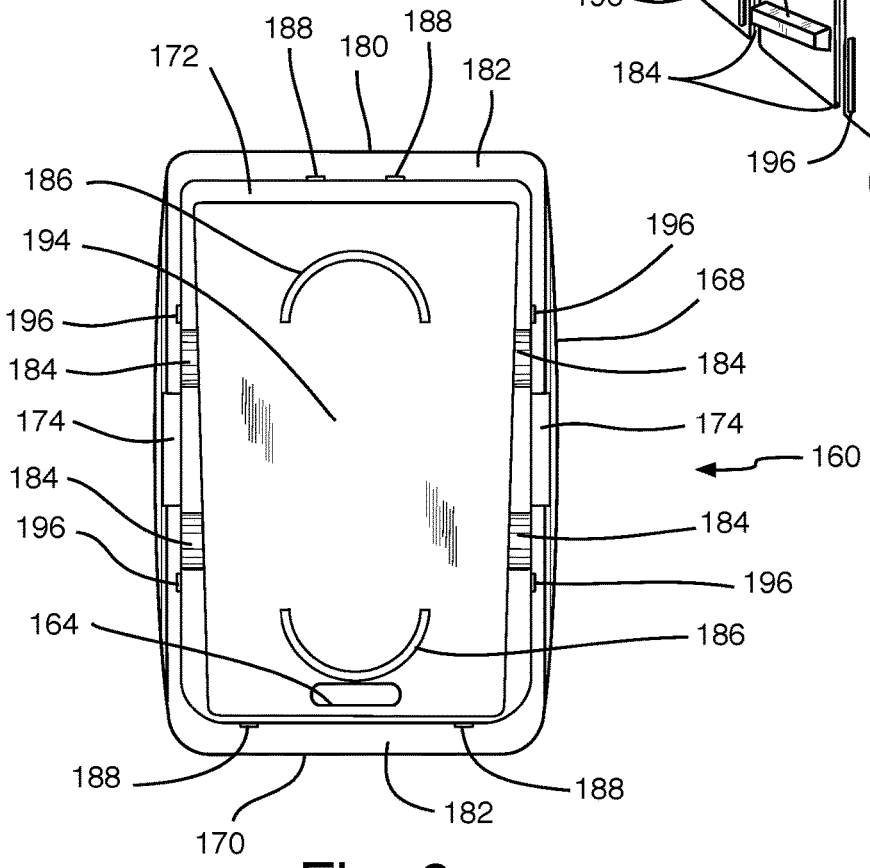
FIG. 6 is a top view of the magazine base that secures the present invention sleeve assembly.

As seen in FIGS. 4, 5, and 6, magazine base assembly 160 comprises base exterior face 162, base interior face 194, perimeter edge 168, forward face 170, base edge 172, first and second lateral walls 176, grip sections 178, aft face 180, forward wall 190, and aft wall 192. First and second lateral walls 176 comprise first and second tabs 174 respectively. Base exterior face 162 comprises hole 164 and indents 166. First and second lateral walls 176, forward wall 190, and aft wall 192 extend from base interior face 194 defining lip 182. First and second lateral walls 176 are parallel to each other, and are perpendicular to forward wall 190 and aft wall 192. Forward wall 190 defines a third predetermined distance from base interior face 194 to base edge 172, and aft wall 192 comprises a fourth predetermined distance from base interior face 194 to base edge 172. The third predetermined distance is greater than the fourth predetermined distance.

Figure 8:
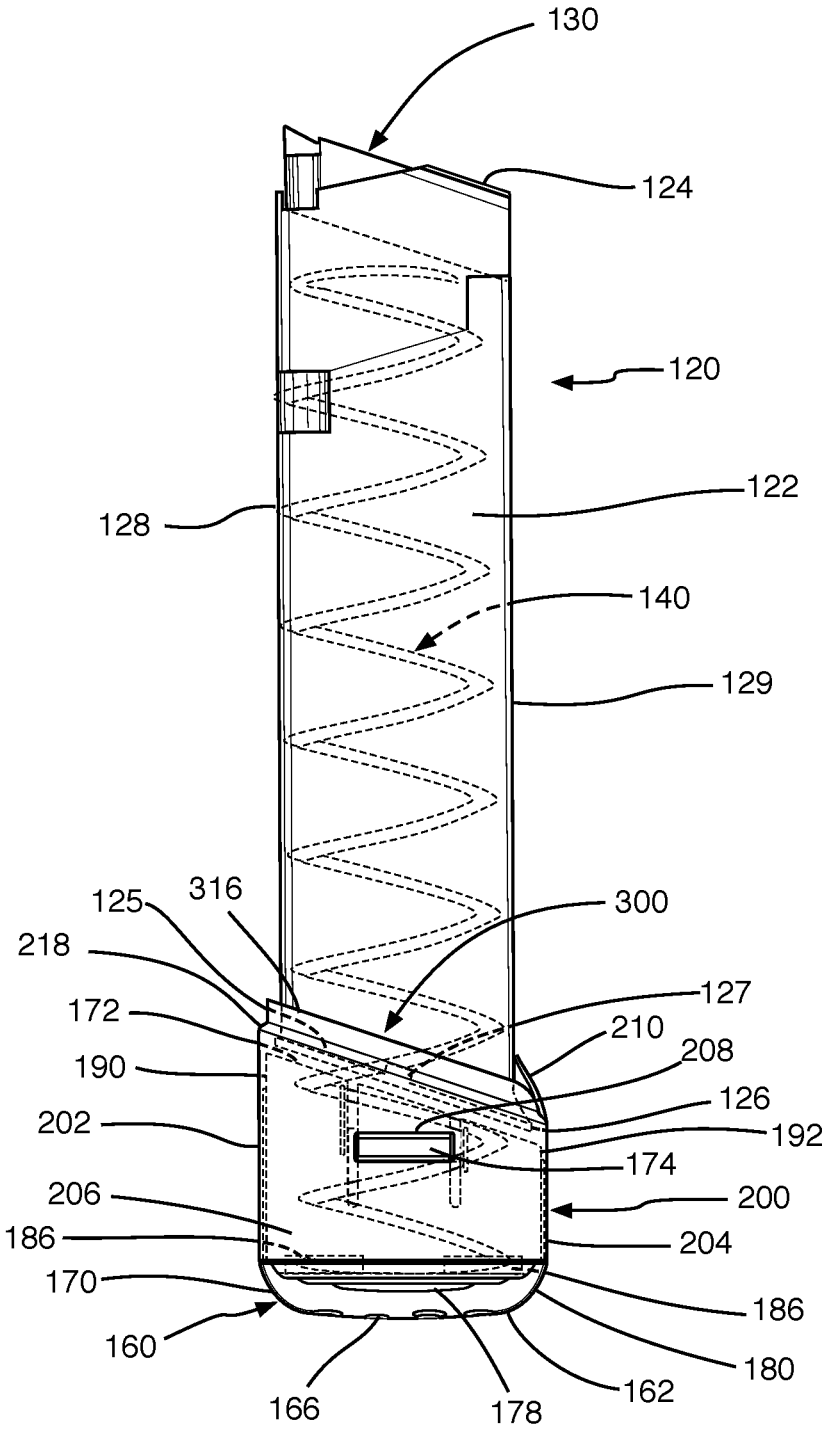
FIG. 8 is a side view of an assembled magazine assembly including the magazine base securing the present invention sleeve assembly.

First and second lateral walls 176 each comprise apertures 184 and lateral ridges 196. In a preferred embodiment, each tab 174 is in between respective first and second apertures 184 and first and second ridges 196. Forward wall 190 and aft wall 192 comprise ridges 188. In a preferred embodiment, ridges 188 extend from lip 182 toward base edge 172 without reaching base edge 172. Ridges 188 and lateral ridges 196 help to fix magazine base assembly 160 onto sleeve assembly 200, thus providing stability to an assembled magazine assembly, as seen in FIG. 8. Base interior face 194 comprises first and second semicircular protrusions 186. First and second semicircular protrusions 186 secure magazine spring 140, seen in FIG. 9.

Figure 7:
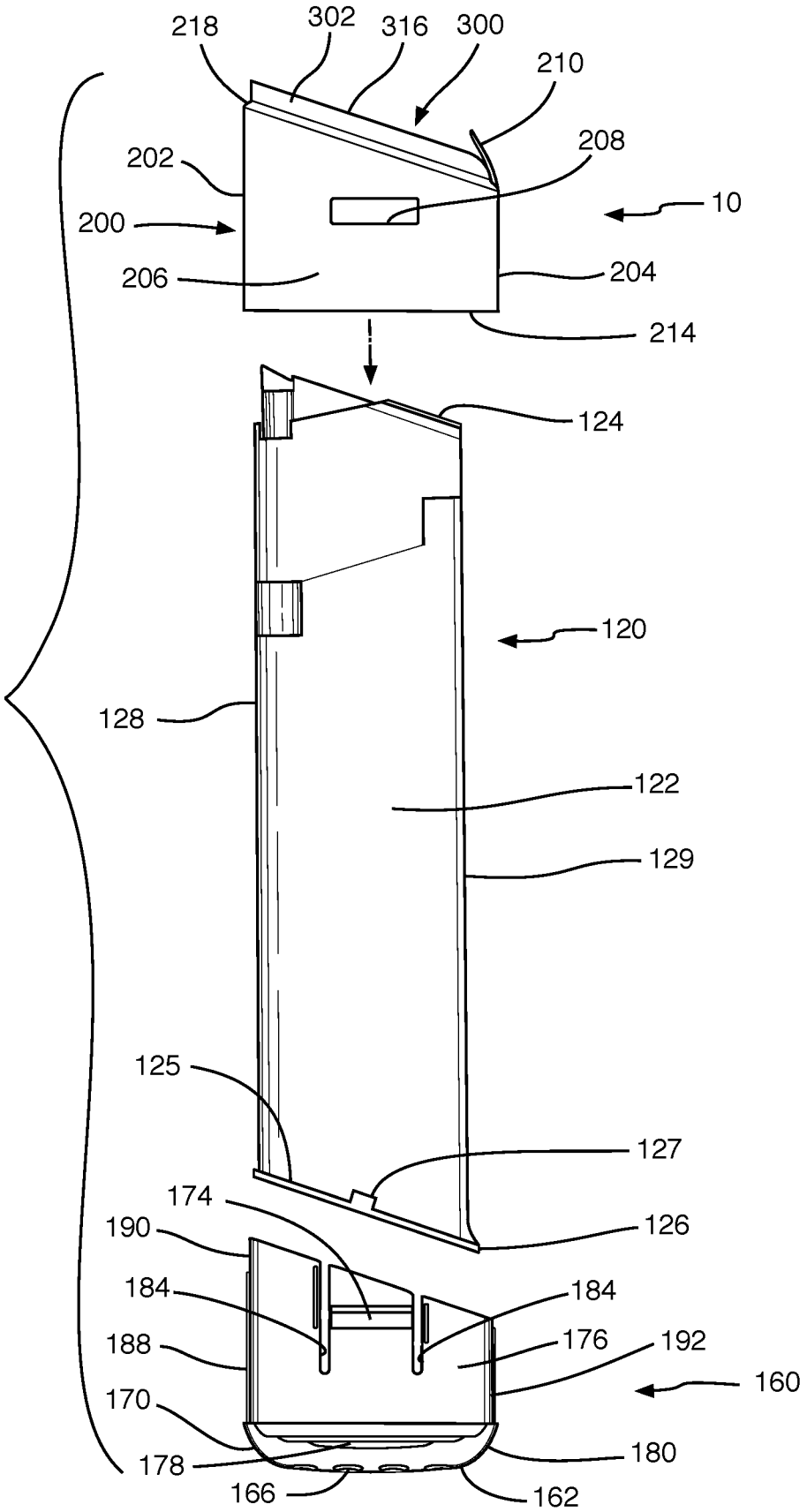
FIG. 7 is a side view of a disassembled magazine assembly including the present invention sleeve assembly and the magazine base.

As seen in FIG. 7, magazine tube assembly 120 comprises sidewall 122, magazine top edge 124, magazine lip 125, magazine base edge 126, first and second magazine tabs 127, magazine forward face 128, and magazine aft face 129.

As seen in FIG. 8, sleeve assembly 200 mounts onto magazine tube assembly 120 and secures onto magazine base assembly 160. Furthermore, sleeve assembly 200 mounts onto magazine tube assembly 120, whereby sleeve lip 218 mounts onto magazine lip 125, and first and second sleeve indents 312, seen in FIG. 1, receive first and second magazine tabs 127 respectively. In addition, sleeve assembly 200 also mounts onto magazine tube assembly 120, whereby top walls 300 fit tightly around magazine tube assembly 120. Thus, preventing magazine tube assembly 120 from flexing or deforming as a result of impact forces, and therefore providing more stability to an assembled magazine assembly as illustrated.

Sleeve assembly 200 secured onto magazine base assembly 160, whereby first and second sleeve holes 208 receive first and second tabs 174 respectively. When assembled, sleeve forward face 202 aligns with forward wall 190, sleeve aft wall 204 aligns with aft wall 192, base edge 172 aligns with magazine base edge 126, and semicircular tab 210 contacts magazine aft face 129. Follower 130 and magazine spring 140 are assembled within magazine tube assembly 120. Top walls 300, above sleeve lip 218, form a perimeter, which encapsulate magazine tube assembly 120 and prevents magazine tube assembly 120 from flexing or deforming from impact forces. Therefore, the entire assembled magazine assembly stays in place to prevent accidental disassembly.

Figure 9:
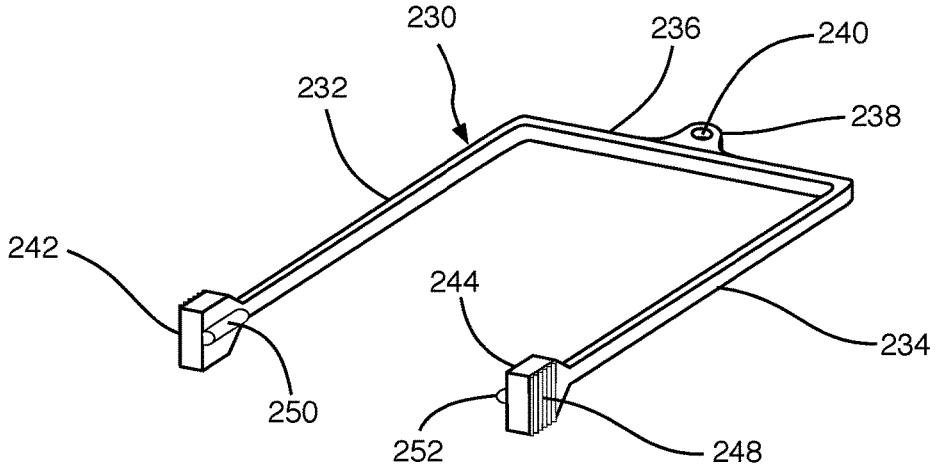
FIG. 9 is an isometric view of a sleeve disassembly tool.
Figure 10:
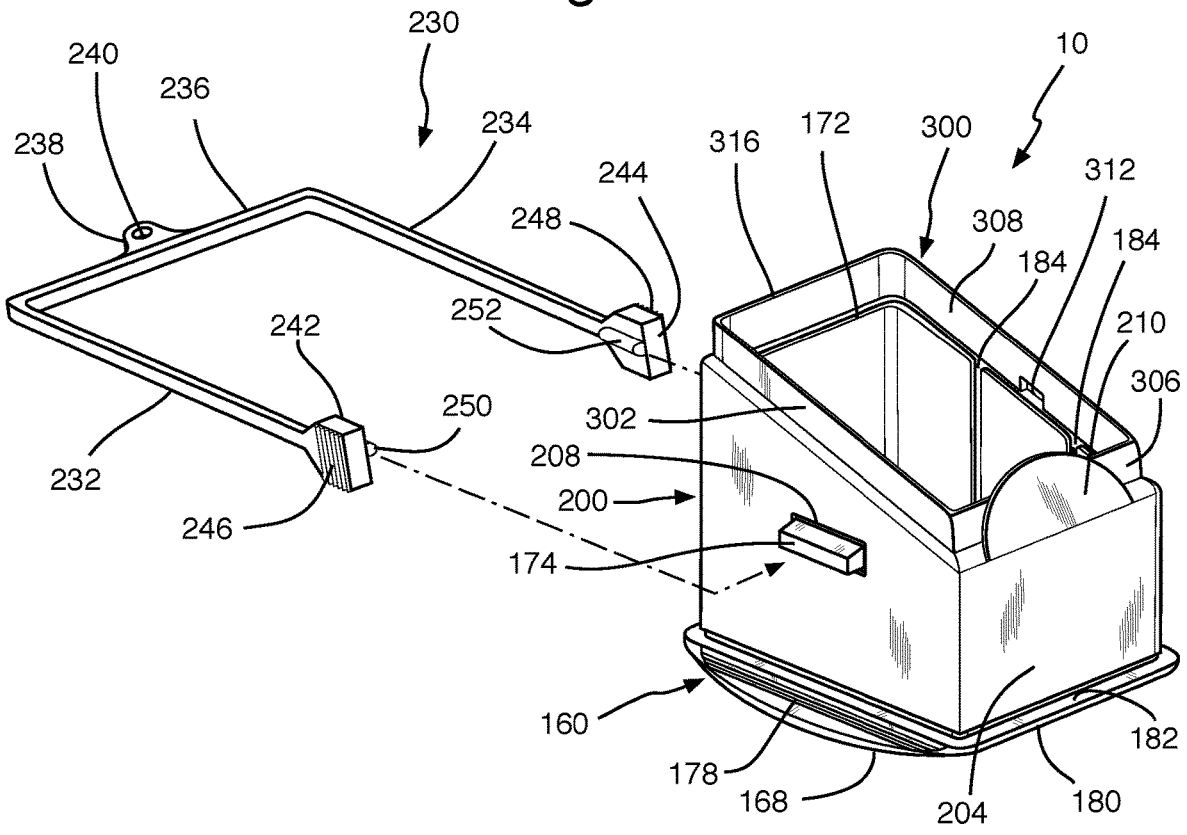
FIG. 10 is an isometric view of the sleeve disassembly tool used to disassemble the present invention sleeve assembly from the magazine base.

As seen in FIGS. 9 and 10, sleeve disassembly tool 230 is U-shaped and comprises first and second lateral members 232 and 234, and central member 236. First and second lateral members 232 and 234 comprise first and second lateral tabs 242 and 244 respectively. First and second lateral tabs 242 and 244 comprise first and second ridges 250 and 252 respectively at respective inner sides, and tab grips 246 and 248 respectively at respective external sides. Central member 236 comprises protrusion 238 having hole 240. Sleeve disassembly tool 230 is used to disassemble sleeve assembly 200 from magazine base assembly 160, whereby a predetermined force is applied onto first and second lateral tabs 242 and 244, biasing first and second ridges 250 and 252 against first and second tabs 174, to release first and second tabs 174 from respective sleeve holes 208.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A firearm magazine sleeve, comprising:

A) a sleeve assembly, said sleeve assembly comprises a sleeve forward wall, a sleeve aft wall having an aft top edge, first and second sleeve lateral walls, a bottom edge, a sleeve lip, and a sleeve internal face, said sleeve assembly further comprising top walls, said top walls comprise first and second top lateral walls comprising first and second top lateral internal faces respectively, a top forward wall, a top aft wall, corners, an interior edge, and a top edge, whereby said top walls extend from said sleeve lip to said top edge, said first and second top lateral internal faces comprise first and second sleeve indents, respectively;

B) a magazine tube assembly whereas said top walls, extending from said sleeve lip, form a perimeter, which encapsulate said magazine tube assembly; and C) a magazine base assembly, wherein said sleeve assembly mounts onto said magazine tube assembly and secures onto said magazine base assembly.

2. The firearm magazine sleeve set forth in claim 1, wherein said first and second sleeve lateral walls comprise first and second sleeve holes respectively.

3. The firearm magazine sleeve set forth in claim 2, wherein said magazine tube assembly comprises a sidewall, a magazine top edge, a magazine lip, a magazine base edge, first and second magazine tabs, a magazine forward face, and a magazine aft face.

4. The firearm magazine sleeve set forth in claim 3, wherein said magazine base assembly comprises a base exterior face with indents, a base interior face, a perimeter edge, a forward face, a base edge, first and second lateral walls, grip sections, an aft face, a forward wall, and an aft wall.

5. The firearm magazine sleeve set forth in claim 4, wherein said first and second lateral walls comprise first and second tabs respectively.

6. The firearm magazine sleeve set forth in claim 5, wherein said first and second lateral walls, said forward wall, and said aft wall extend from said base interior face defining a lip.

7. The firearm magazine sleeve set forth in claim 5, wherein said first and second lateral walls each comprises apertures and lateral ridges, and said forward wall and said aft wall comprise ridges.

8. The firearm magazine sleeve set forth in claim 5, wherein said sleeve assembly secures onto said magazine base assembly, whereby said first and second sleeve holes receive said first and second tabs respectively.

9. The firearm magazine sleeve set forth in claim 4, wherein said sleeve assembly mounts onto said magazine tube assembly, whereby said sleeve lip mounts onto said magazine lip and said first and second sleeve indents receive said first and second magazine tabs respectively.

10. The firearm magazine sleeve set forth in claim 1, wherein said sleeve assembly further comprises a semicircular tab.

11. The firearm magazine sleeve set forth in claim 10, wherein said semicircular tab extends from said aft top edge toward said top aft wall, and protrudes from said top edge.

12. The firearm magazine sleeve set forth in claim 1, wherein said first and second sleeve indents extend from said interior edge.

13. The firearm magazine sleeve set forth in claim 1, wherein said top walls extend from said sleeve lip to said top edge.

14. The firearm magazine sleeve set forth in claim 1, wherein said top walls define a first rectangular shape having a first predetermined perimeter, and sleeve assembly defines a second rectangular shape having a second predetermined perimeter.

15. The firearm magazine sleeve set forth in claim 14, wherein said first predetermined perimeter is smaller than said second predetermined perimeter.

* * * * *